US008783600B1

(12) United States Patent
Myron

(10) Patent No.: US 8,783,600 B1
(45) Date of Patent: Jul. 22, 2014

(54) CENTER SPREADER ADAPTER TOOL FOR TOILET PAPER ROLLS AND PAPER TOWEL ROLLS THAT DO NOT HAVE INNER CARDBOARD TUBES

(71) Applicant: Richard Myron, Blairstown, NJ (US)

(72) Inventor: Richard Myron, Blairstown, NJ (US)

( * ) Notice: Subject to any disclaimer, the term of this patent is extended or adjusted under 35 U.S.C. 154(b) by 0 days.

(21) Appl. No.: 13/750,045

(22) Filed: Jan. 25, 2013

Related U.S. Application Data

(60) Provisional application No. 61/677,659, filed on Jul. 31, 2012.

(51) Int. Cl.
*B65H 75/18* (2006.01)

(52) U.S. Cl.
USPC ..... 242/596.7; 242/597.5

(58) Field of Classification Search
USPC ..... 242/598, 598.3, 599, 599.4, 597.5, 242/597.6, 596.7
See application file for complete search history.

(56) References Cited

U.S. PATENT DOCUMENTS

| | | | | | |
|---|---|---|---|---|---|
| 850,892 | A | * | 4/1907 | Ball | 242/599.4 |
| 1,674,285 | A | * | 6/1928 | Harvey | 242/571.5 |
| 1,922,716 | A | | 8/1933 | Robinett | |
| 2,522,109 | A | | 9/1950 | Foltis | |
| D180,595 | S | | 7/1957 | Gralewicz | |
| D198,832 | S | | 8/1964 | Moy | |
| D205,497 | S | | 8/1966 | Webber | |
| 3,292,874 | A | * | 12/1966 | Tinkham | 242/571.5 |
| 3,375,995 | A | | 4/1968 | Roman | |
| 3,519,216 | A | * | 7/1970 | Dominick et al. | 242/599.2 |
| D218,331 | S | | 8/1970 | Utz | |
| 3,881,666 | A | * | 5/1975 | Greenhalgh | 242/571.3 |
| 4,149,682 | A | * | 4/1979 | Gustafson et al. | 242/571.3 |
| 4,235,389 | A | | 11/1980 | Ness | |
| D291,518 | S | | 8/1987 | Chap | |
| 4,783,016 | A | * | 11/1988 | Pool | 242/571.4 |
| D324,618 | S | | 3/1992 | Morand | |
| 5,100,075 | A | | 3/1992 | Morand | |
| 5,323,980 | A | * | 6/1994 | Neveu et al. | 242/597.6 |
| 5,366,175 | A | * | 11/1994 | Schutz | 242/597.6 |
| 5,370,339 | A | * | 12/1994 | Moody et al. | 242/597.6 |
| 5,402,978 | A | | 4/1995 | Larson | |
| 5,445,344 | A | * | 8/1995 | Seger et al. | 242/597.3 |
| 5,451,013 | A | | 9/1995 | Schutz | |
| 5,492,280 | A | * | 2/1996 | Corres et al. | 242/130 |

(Continued)

FOREIGN PATENT DOCUMENTS

| | | |
|---|---|---|
| JP | 10127524 | 5/1998 |
| JP | 3071707 | 9/2000 |

OTHER PUBLICATIONS

International Search Report, PCT/US13/46523 filed Jun. 19, 2013, received Sep. 9, 2013, 16 pages.

*Primary Examiner* — William A Rivera
*Assistant Examiner* — Michael Gallion
(74) *Attorney, Agent, or Firm* — Brian S. Steinberger; Law Offices of Brian S. Steinberger, P.A.

(57) ABSTRACT

Tools, devices and methods of modifying existing toilet paper and paper towels that do not have inner cardboard tubes with insert adapters to modify the nondefined openings in the rolls. The adapter tools can slide onto the ends of the spindles and have narrow tip exteriors, and/or have threaded exterior surfaces, and the like. Inserts can have spiral cut grooves or spiral raised ribs, with a chamfered tip end and an enlarged base end.

20 Claims, 23 Drawing Sheets

(56) References Cited

U.S. PATENT DOCUMENTS

| | | | | |
|---|---|---|---|---|
| 5,495,997 | A * | 3/1996 | Moody | 242/561 |
| 5,577,686 | A | 11/1996 | Moody | |
| D381,851 | S | 8/1997 | Sharpe | |
| 5,669,576 | A * | 9/1997 | Moody | 242/560.3 |
| 5,775,632 | A | 7/1998 | Huerta | |
| 5,868,342 | A * | 2/1999 | Moody et al. | 242/560 |
| 6,036,134 | A * | 3/2000 | Moody | 242/422.4 |
| 6,328,246 | B1 * | 12/2001 | Hjort et al. | 242/422.5 |
| 6,360,985 | B1 | 3/2002 | Phelps | |
| 6,439,502 | B1 | 8/2002 | Gemmell | |
| D494,395 | S | 8/2004 | Wolpert | |
| 7,086,628 | B2 | 8/2006 | Neri | |
| 7,350,463 | B2 * | 4/2008 | Blanchard et al. | 101/407.1 |
| 7,513,453 | B2 | 4/2009 | Cattacin | |
| 7,828,240 | B2 * | 11/2010 | Hagleitner | 242/598.3 |
| 7,861,964 | B2 * | 1/2011 | Cittadino et al. | 242/597.5 |
| 8,002,215 | B2 * | 8/2011 | Repp et al. | 242/596.7 |
| 2002/0074450 | A1 | 6/2002 | Tramontina | |
| 2005/0098465 | A1 * | 5/2005 | Wolf | 206/410 |
| 2006/0175459 | A1 * | 8/2006 | Hua | 242/571.7 |
| 2009/0057169 | A1 * | 3/2009 | Kruchoski et al. | 206/225 |
| 2010/0051738 | A1 * | 3/2010 | Harvey et al. | 242/613 |
| 2011/0114778 | A1 * | 5/2011 | Andersson | 242/160.1 |
| 2011/0210199 | A1 * | 9/2011 | Sinsabaugh | 242/600 |
| 2012/0104142 | A1 | 5/2012 | Phelps | |

* cited by examiner

CENTER SPREADER ADAPTER TOOL FOR TOILET PAPER ROLLS AND PAPER TOWEL ROLLS THAT DO NOT HAVE INNER CARDBOARD TUBES

This invention claims the benefit of priority to U.S. Provisional Patent Application Ser. No. 61/677,659 filed Jul. 31, 2012, which is incorporated by reference in its' entirety.

FIELD OF INVENTION

This invention relates to toilet paper rolls and paper towel rolls, in particular to adapter tools, devices and methods for enlarging the central opening in toilet paper rolls and paper towel rolls that do not have inner cardboard tubes, using inserts with spiral cut grooves or spiral raised ribs on outer surfaces of the inserts, and chamfered tip ends and enlarged base ends on the inserts.

BACKGROUND AND PRIOR ART

Toilet paper rolls generally include rolling sheets of paper about a central cardboard tube. The paper usually is glued or adhered to the inner tube. The inner tubes are usually mounted over spindles or telescoping cylinders in toilet paper dispensers. Once the toilet paper has been used, up, changing toilet roll dispensers has usually required the consumer to pull off the spindle or telescoping cylinders and then mount a new spare toilet paper roll by inserting the spindle into the center opening of the central cardboard tube and mounting the spindle with mounted toilet paper roll back to the toilet paper dispenser.

In recent years, there has been a push to start removing the central cardboard tube in order to save paper costs and manufacturing costs by eliminating the central cardboard tube entirely, and selling toilet paper rolls without any central cardboard tubes.

Furthermore, cardboard tubes have created wasted paper. The portion of the toilet paper glued to the cardboard tube is generally unusable when the roll is nearly empty.

Still furthermore, the cardboard tubes are also an extra wasted expense and by-product since the cardboard tubes are often thrown away when the roll is used up. Even if the tubes are recycled, there is a lost cost involved.

Thus, manufacturers are now starting to increasingly manufacturer toilet paper rolls without the central cardboard tube.

The problem with no longer having the central tube creates a problem where the center opening in the roll is no longer easily defined.

With the tubeless toilet paper rolls, consumers can have a difficult time trying to push and jam the spindle or telescoping cylinders of the toilet paper dispenser through the undefined hole in the new paper rolls that do not have cardboard center tubes.

This problem is increasing further in view of the fact that paper towels are now starting to be made also without the center cardboard tube for similar reasons.

Thus, the need exists for solutions to the problems identified above.

SUMMARY OF THE INVENTION

A primary objective of the present invention is to provide adapter tools, devices and methods for enlarging the central opening in toilet paper rolls and paper towel rolls that do not have inner cardboard tubes with an insert tool having a spiral groove cut on the exterior surface.

A secondary objective of the present invention is to provide adapter tools, devices and methods for enlarging the central opening in toilet paper rolls and paper towel rolls that do not have inner cardboard tubes with an insert tool having a spiral raised rib on the exterior surface.

A third objective of the present invention is to provide for adapter tools, devices and methods that modify existing spindles on toilet paper and paper towel dispensers with inserts to hold paper rolls that do not have inner cardboard tubes.

A fourth objective of the present invention is to provide for reusable adapter tools, devices and methods that can be used with or without toilet paper rolls and paper towel rolls that do not have inner cardboard tubes.

Adapter tools and devices having spiral grooves or spiral raised ribs that facilitate easier insertion of toilet roll holders (spindle) and/or paper towel holders (spindle), thereby reducing damage to inner sheets of paper and improving the dispensing of the product. The adapters tools and devices can be integrated with the spindle or could be a standalone device used as a tool to expand the center of the roll and/or create a smooth interior surface and/or guide the spindle into place. The adapter tools and devices can also be reusable.

An adapter tool for paper rolls that do not have inner cardboard tubes, can include a hollow cylinder having a first end and a second end opposite the first end with a generally uniform diameter opening therebetween, and a spiral on the exterior surface of the hollow cylinder between the first end and the second end, wherein the first end is adapted to be pushed into a central opening of a paper roll that does not have an inner cardboard tube, and the insert is able to be rotated by the second end until substantially all of the insert is located inside the central opening of the paper roll.

The hollow cylinder can have a length of at least approximately 4 inches between the first end and the second end, and the paper roll is a toilet paper roll without an inner cardboard tube.

The first end can have a chamfered edge, and the second end can have an enlarged base having an outer diameter greater than the outer diameter of the hollow cylinder. The chamfered edge can be an angle of approximately 30 degrees.

The spiral can include a spiral cut groove. The cut groove can be approximately 0.063 inches deep. The spiral cut groove can have a width of approximately 0.125 inches. The spiral cut groove can have an approximately 1 inch spiral pitch.

The spiral can include a spiral raised rib. The spiral raised rib can have a height of approximately 0.3 inches. The spiral raised rib can have a thickness of approximately 0.125 inches. The spiral rib can have an approximately 1 inch spiral pitch.

The hollow cylinder can have a length of at least approximately 6 inches between the first end and the second end, and the paper roll is a paper towel roll without an inner cardboard tube.

A method of mounting paper towel rolls that do not have inner cardboard tubes, on paper dispensers, can include the steps of providing a paper roll with a central opening that does not have an inner cardboard tube, the roll being selected from a toilet paper roll and a paper towel roll, providing a rigid hollow cylinder having a tip end with a chamfered edge and an opposite end with an enlarged base, providing a spiral on an exterior surface of the cylinder between the tip end and the base, and pushing and rotating the tip end of the base into the central opening of the paper roll with the enlarged base until the cylinder is substantially inside the paper roll, and the enlarged base abuts against a side surface of the paper roll.

The method can include the steps of providing a spiral groove or spiral raised rib, and providing the spiral with an approximately 1.00 inch spiral pitch.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The component labels will now be described.

10 Toilet paper roll plastic tube insert with spiral groove.
12 tip end of insert
20 Toilet paper roll mounting bracket/dispenser or stand.
30 Toilet paper roll mounting post/rod/telescoping cylinder.
40 Toilet paper roll without cardboard tube insert.
50 Hole in toilet paper roll.
60 Spiral motion required to insert plastic tube insert into the hole in a paper product roll.
70 Linear push motion required to insert plastic tube insert into the hole in a paper product roll.
80 Spiral groove cut into outside surface of plastic tube insert.
90 Flange on end of plastic tube insert stops the insert when it contacts the end of the paper product roll.
100 Hole through the center of the plastic tube insert allows insertion of paper product mounting rod or post.
110 Holes in toilet paper roll mounting bracket accept tenons on mounting rod.
120 Tenons on toilet paper mounting rod.
130 Paper towel roll plastic tube insert with spiral groove.
132. Tip end of insert
140 Paper towel roll without cardboard tube insert.
150 Hole in paper towel roll.
160 Paper towel holder, such as a stand, dispenser, bracket.
170 Base of towel holder.
180 Post of towel holder.

190 Toilet paper roll plastic tube insert with spiral raised rib on the outside.

200 Raised spiral rib on outside of tube insert.

Toilet Paper Insert with Spiral Groove Cuts

Figure 1:
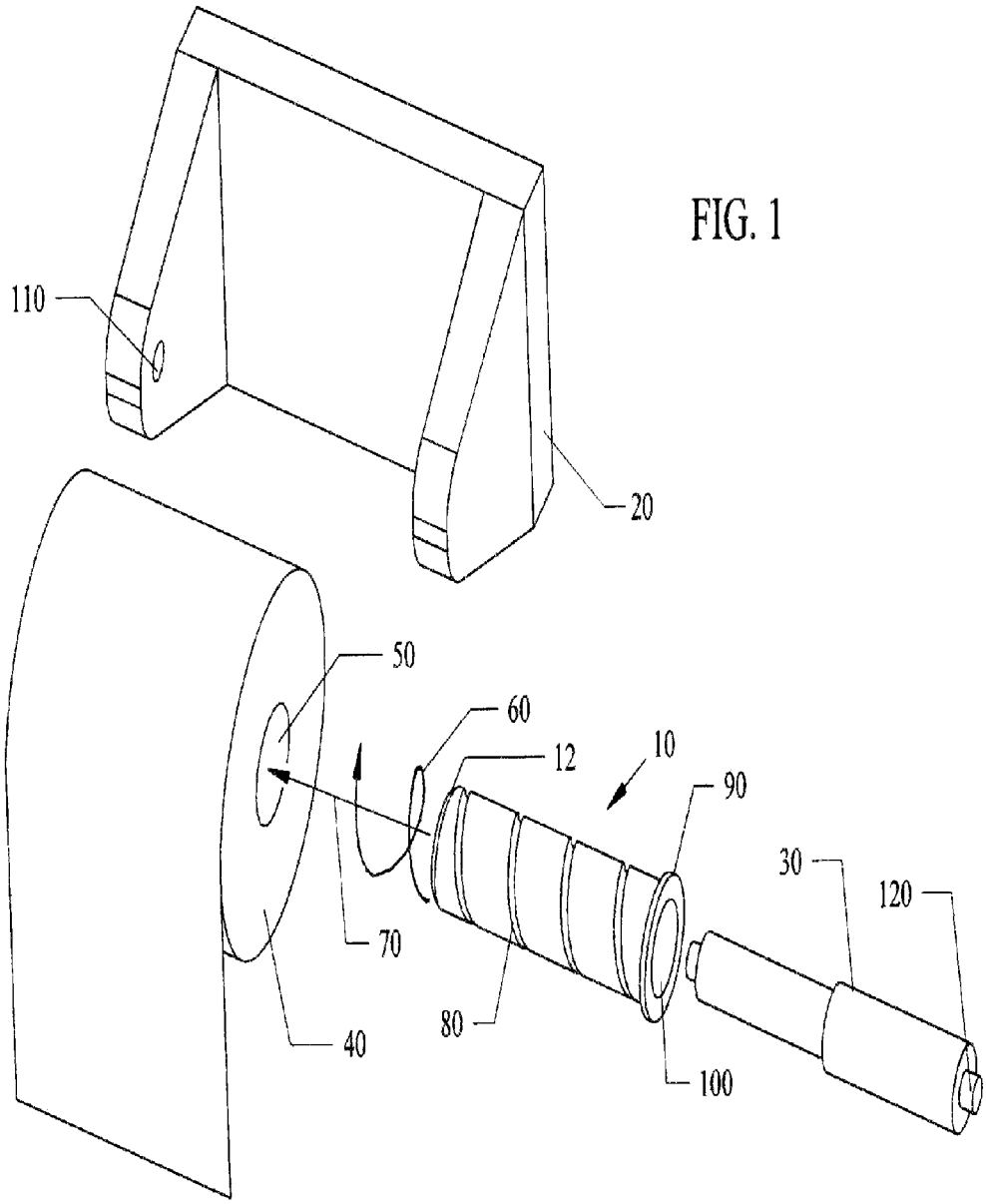
FIG. 1 is a perspective exploded view of a toilet paper roll insert separated from toilet paper roll having no center cardboard core tube, telescoping cylinder and dispenser.
Figure 2:
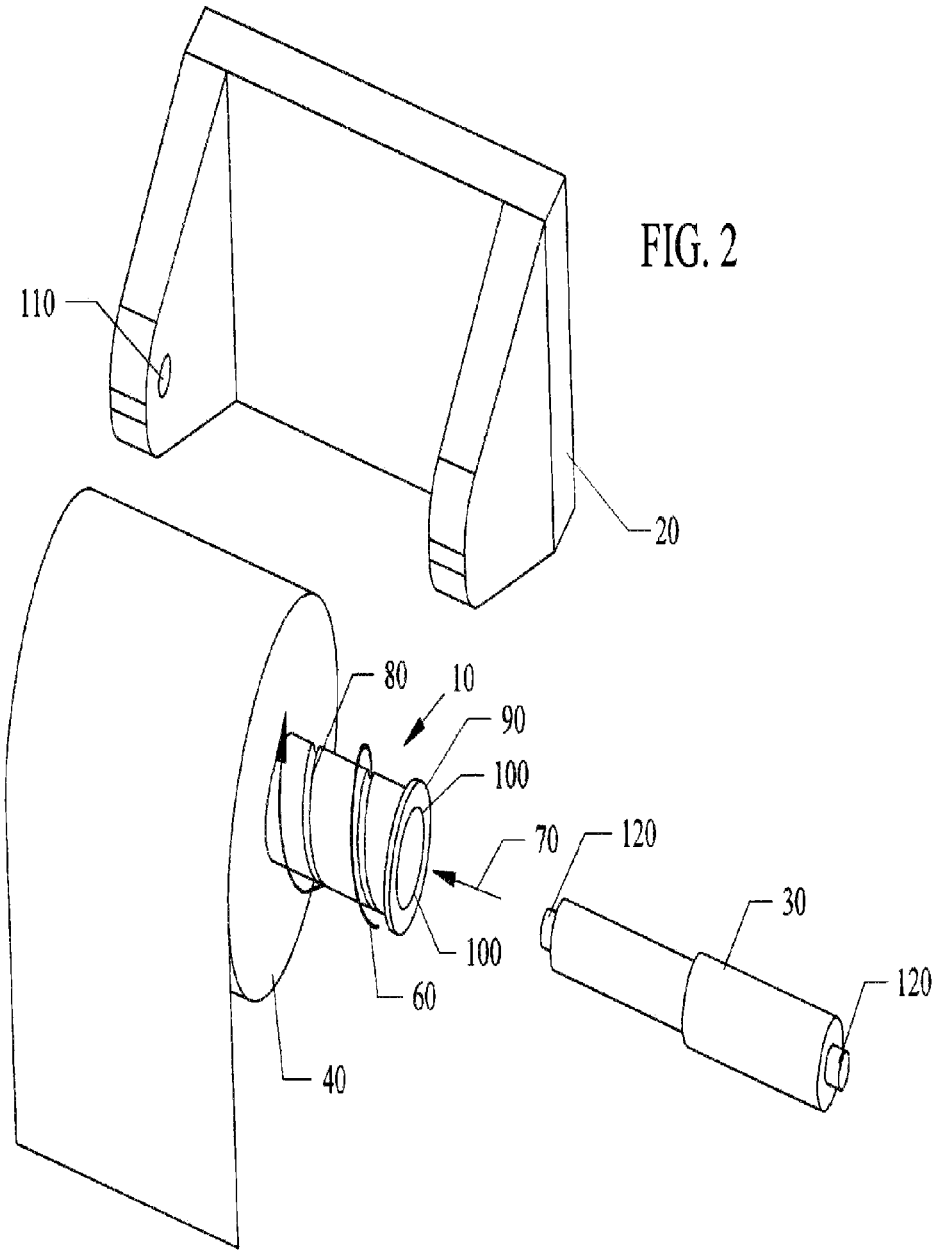
FIG. 2 is another perspective view of the insert starting to be inserted into the toilet paper roll of FIG. 1.
Figure 3:
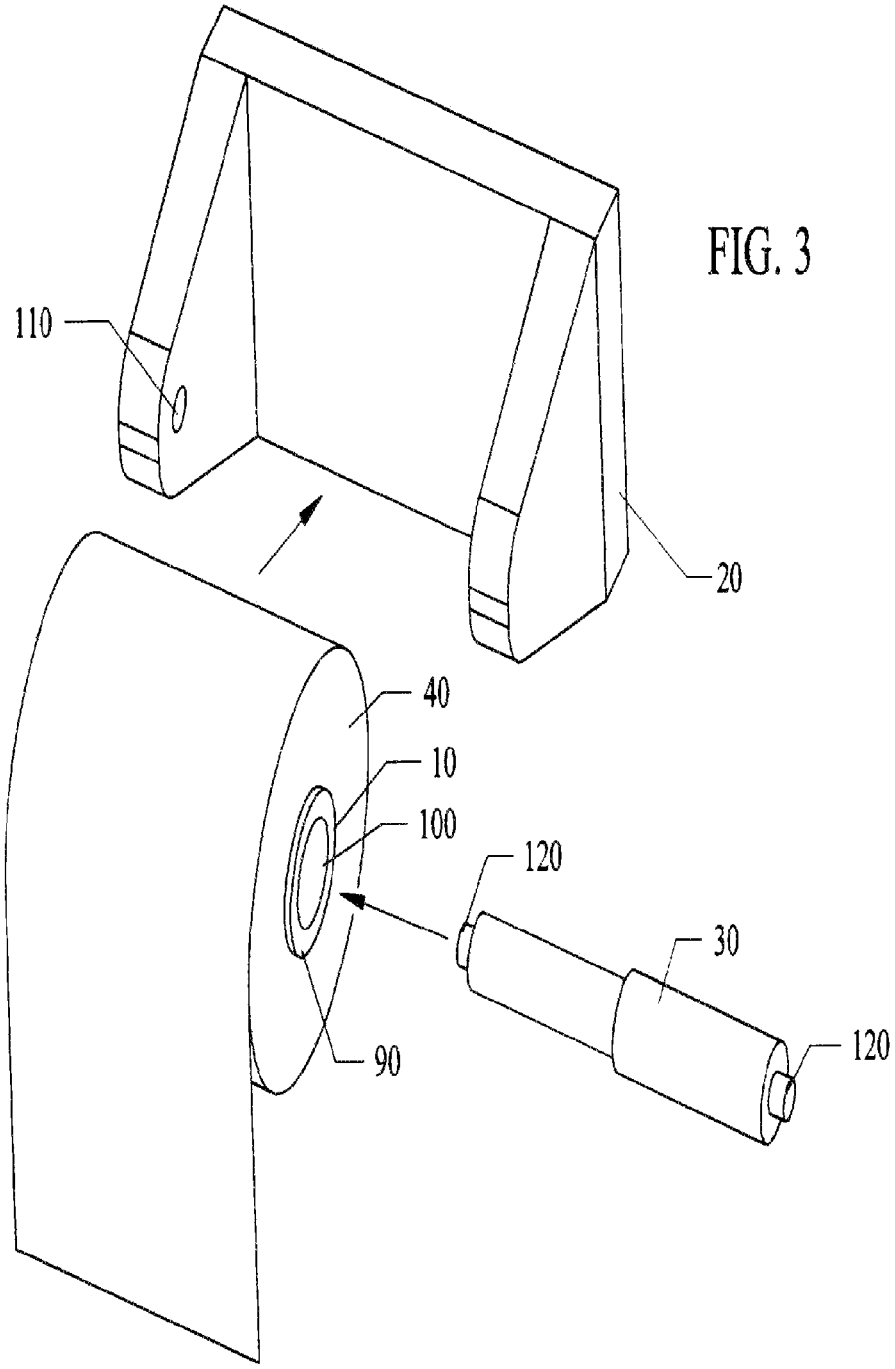
FIG. 3 is another perspective view of the insert of fully installed within the toilet paper roll of FIG. 1.
Figure 4:
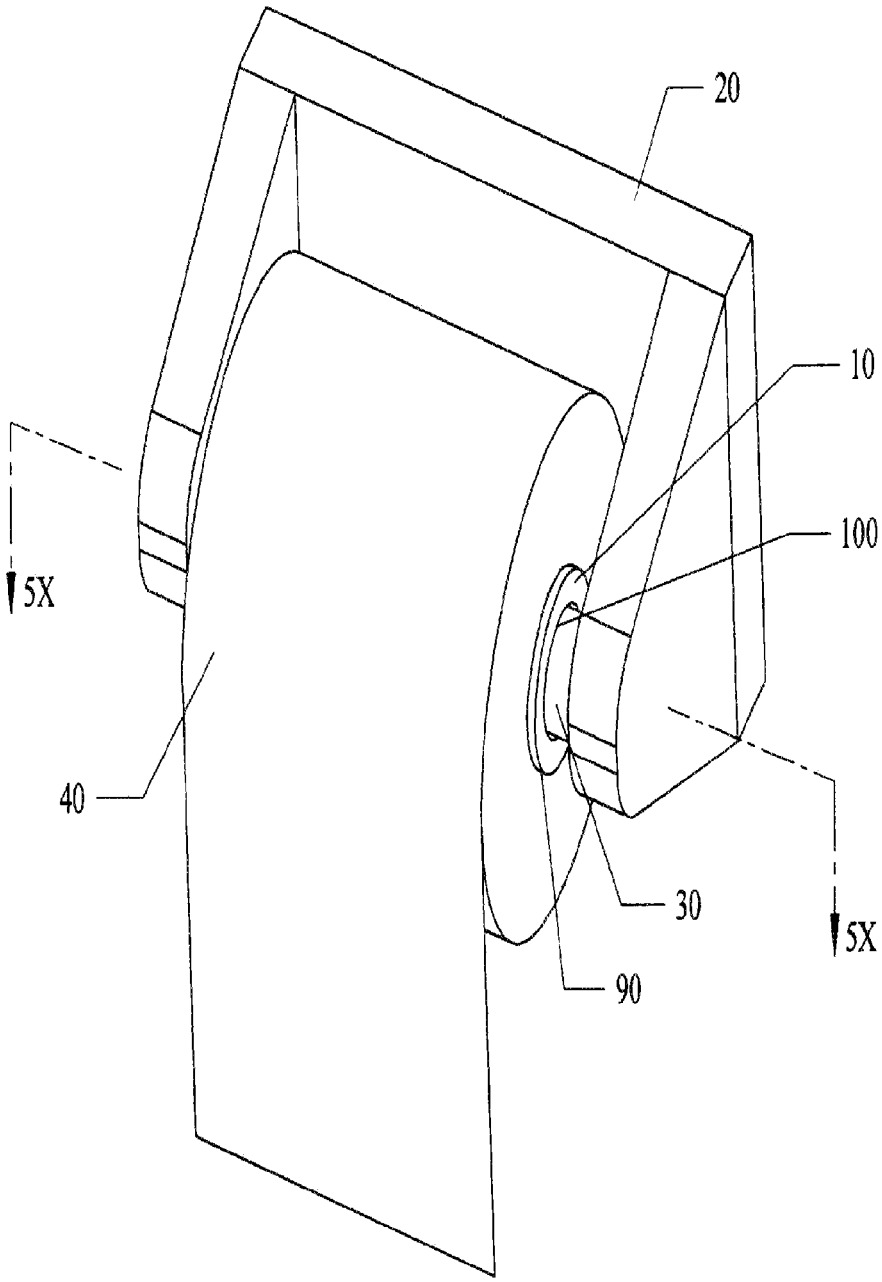
FIG. 4 is a perspective view of the insert installed toilet paper roll of FIG. 3 installed on the dispenser.
Figure 5:
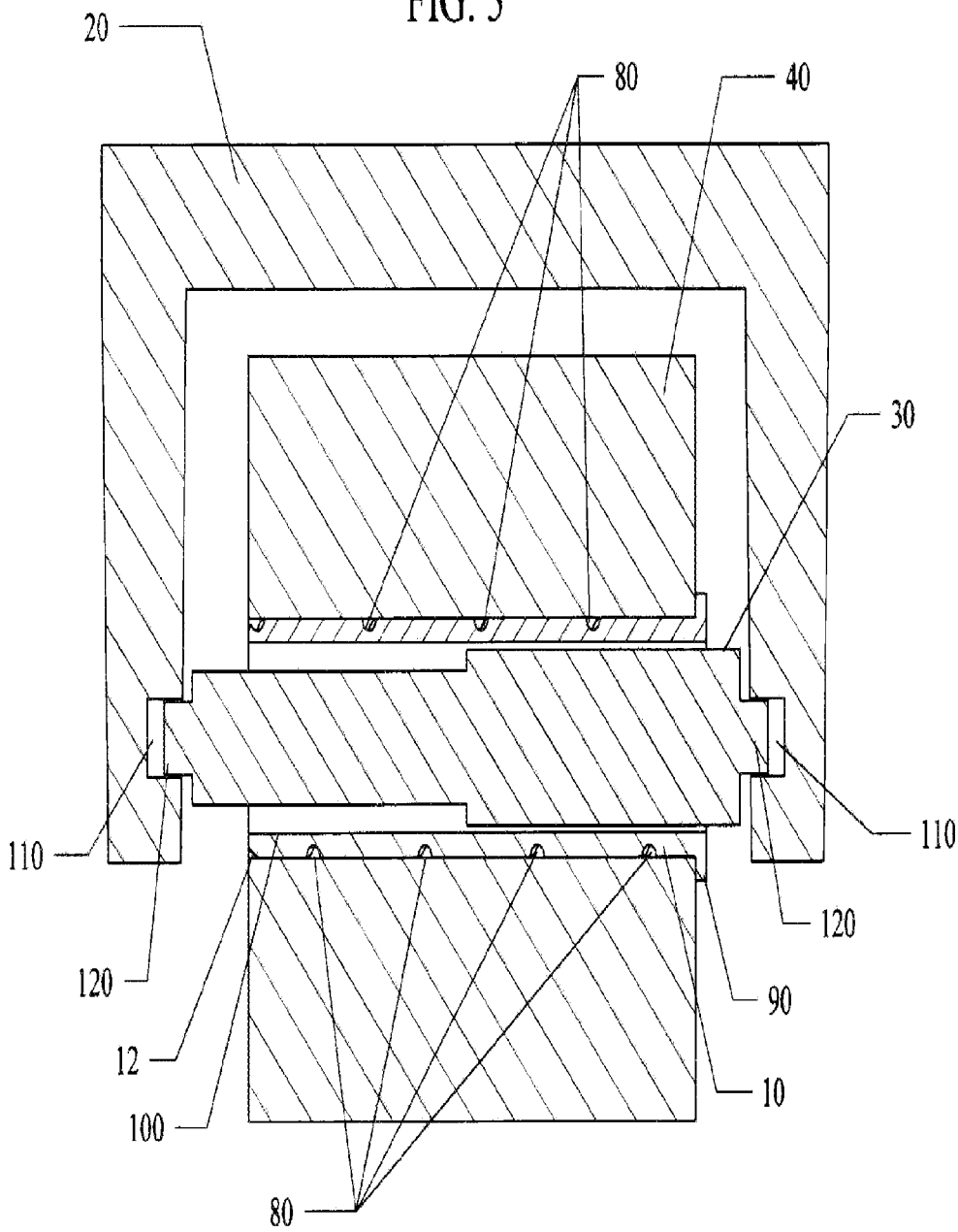
FIG. 5 is a cross-sectional view of the installed toilet paper roll on the dispenser of FIG. 5 along arrow 5X.

FIG. 1 is a perspective exploded view of a toilet paper roll insert 10 separated from toilet paper roll 40 having no center cardboard core tube, post/rod/telescoping cylinder 30 and dispenser 20. FIG. 2 is another perspective view of the insert 10 starting to be inserted into the toilet paper roll 40 of FIG. 1. FIG. 3 is another perspective view of the insert 10 of fully installed within the toilet paper roll 40 of FIG. 1. FIG. 4 is a perspective view of the insert 10 installed toilet paper roll 40 of FIG. 3 installed on the dispenser 29 where the tenons 120 on the post/rod/telescoping cylinder 30 are inserted into mating holes 110 in the toilet paper roll mounting bracket/dispenser. FIG. 5 is a cross-sectional view of the installed toilet paper roll 40 on the dispenser 20 of FIG. 5 along arrow 5X.

Referring to FIGS. 1-5, the novel insert 10 can be a hollow plastic tube having a flange 90 on one end and a tip end 12 having a chamfered tip edges about the perimeter of the tip end 12. The insert can have a spiral groove 80 cut onto the outside surface of the plastic tube insert 10. The toilet paper roll 40 can be one without an axial cardboard tube, where the central opening 50 can be small and not clearly defined. The installer can take the insert 10 by base flange 90 and position the tip end 12 at the front of the hole 50. The installer can push in the direction of arrow 70 and rotate the insert clockwise in the direction of arrow 60 so that that chamfered tip edges drive into the hole 50 until the insert 10 is fully inserted where the flange 90 abuts against one side of the roll 40. In the installed position, the central hole 50 of the roll can be generally made uniform in diameter and have inner walls that abut against the outer surface of the insert 10.

Next the toilet roll mounting rod/telescoping cylinder can be inserted into the central hole 100 through the center of the insert 10. The opposite facing tenons 120 on the post/rod/telescoping cylinders 30 can be placed into mounting holes 110 on the paper roll dispenser 20. The insert is more fully described in relation to FIGS. 11-20

Figure 11:
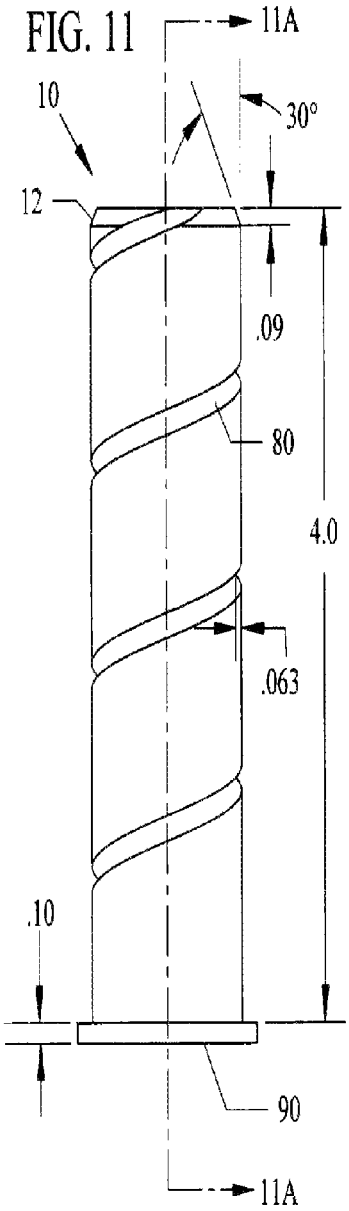
FIG. 11 is a front side view of the toilet paper insert with spiral grooves cut into the outer wall of FIGS. 1-5.
Figure 11A:
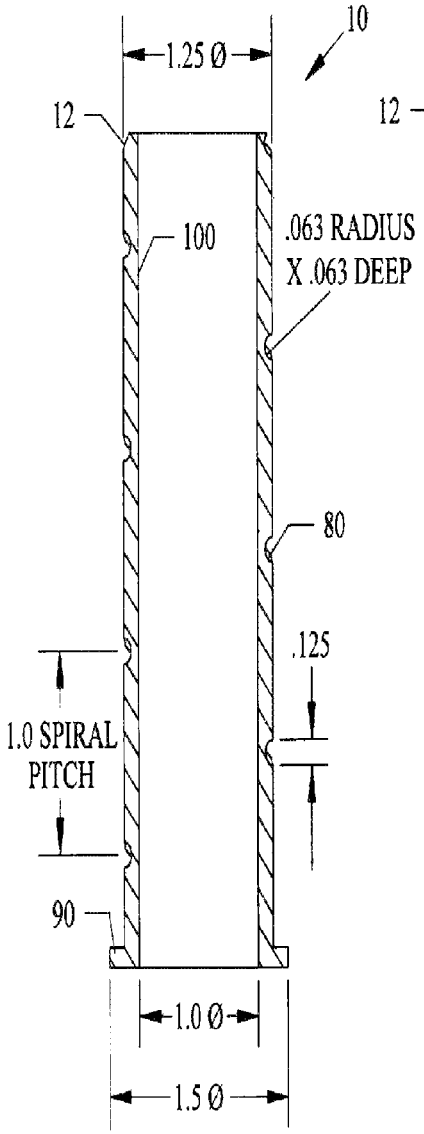
FIG. 11A is a cross-sectional view of the insert of FIG. 11 along arrows 11A.
Figure 12:
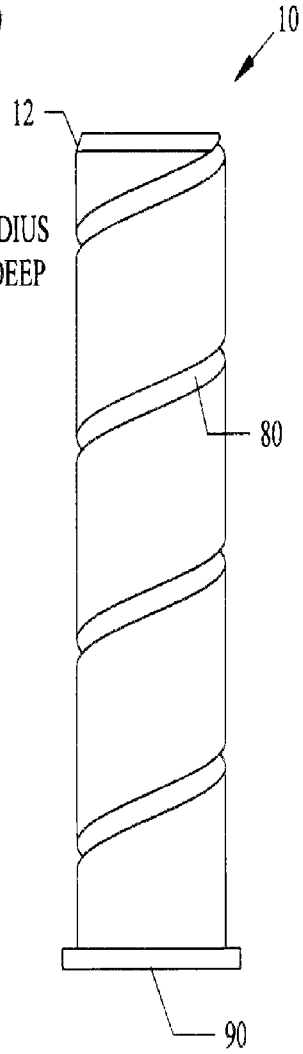
FIG. 12 is a left side view of the toilet paper insert with spiral cut grooves of FIG. 11.
Figure 13:
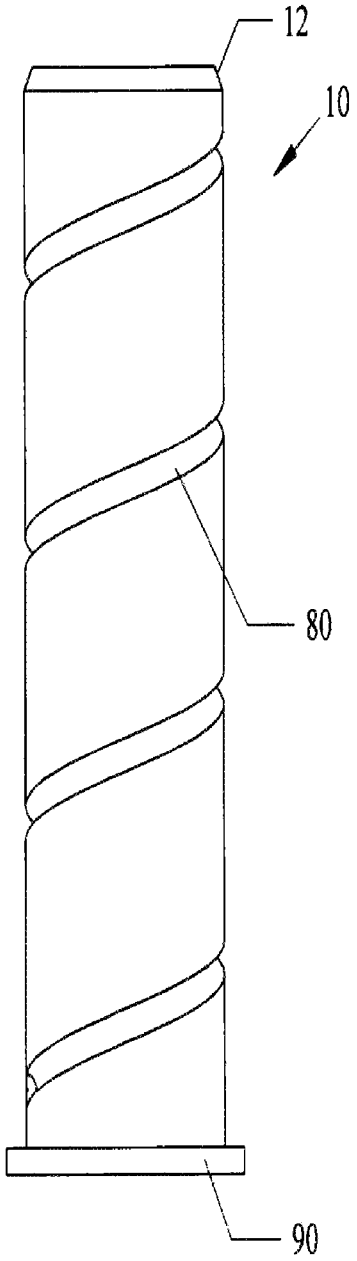
FIG. 13 is a back side view of the toilet paper insert with spiral cut grooves of FIG. 11.
Figure 14:
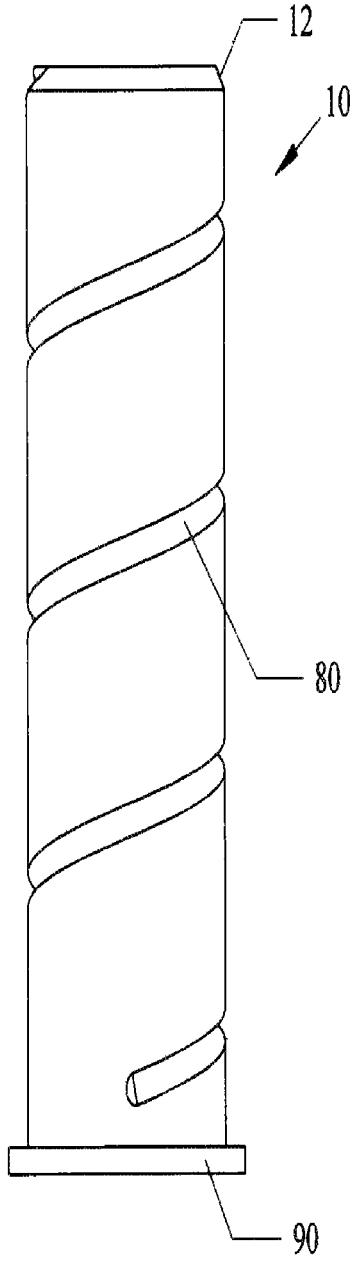
FIG. 14 is a right side view of the toilet paper insert with spiral cut grooves of FIG. 11.
Figure 15:
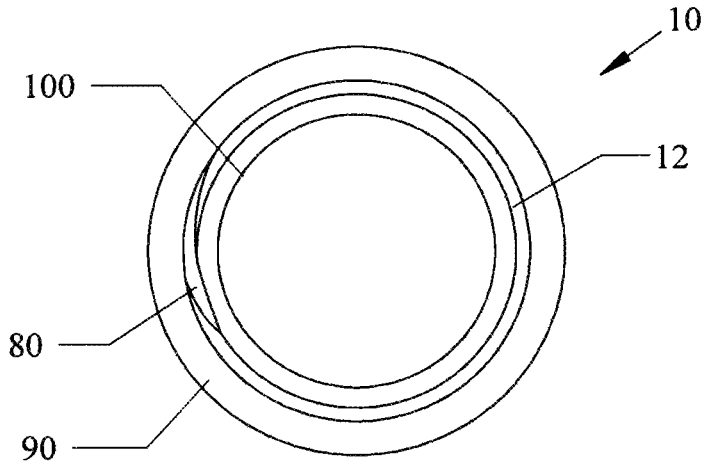
FIG. 15 is a top end view of the toilet paper insert with spiral cut grooves of FIG. 11.
Figure 16:
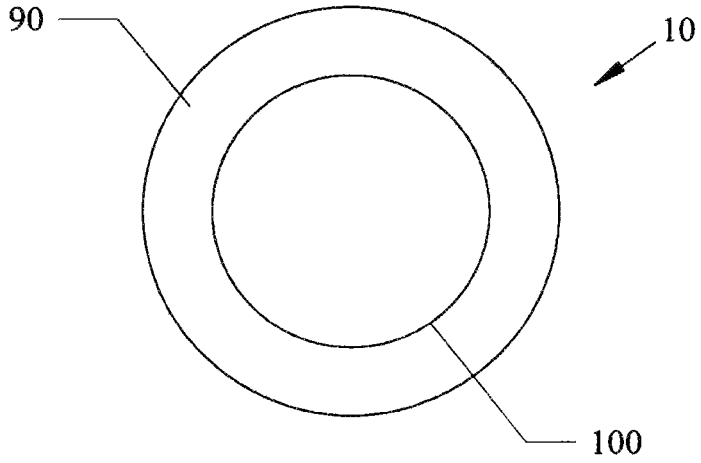
FIG. 16 is a bottom end view of the toilet paper insert with spiral cut grooves of FIG. 11.
Figure 17:
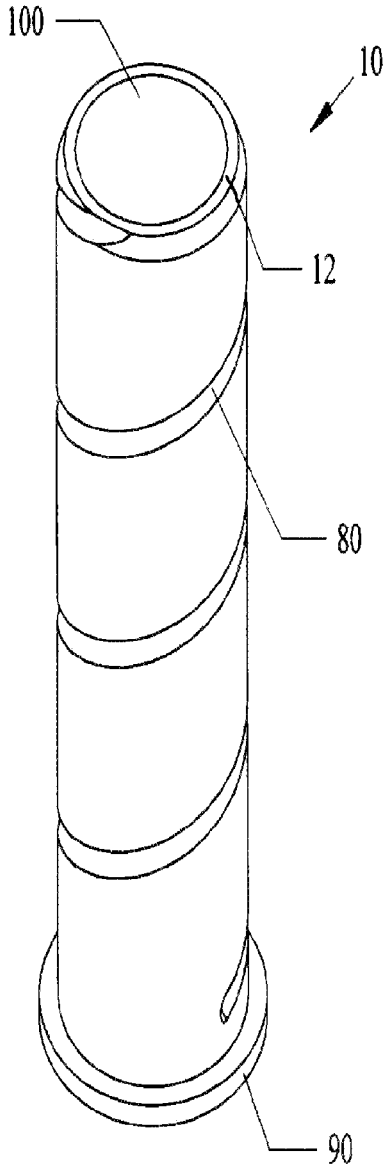
FIG. 17 is a front side top perspective view of the toilet paper insert with spiral cut grooves of FIG. 11.
Figure 18:
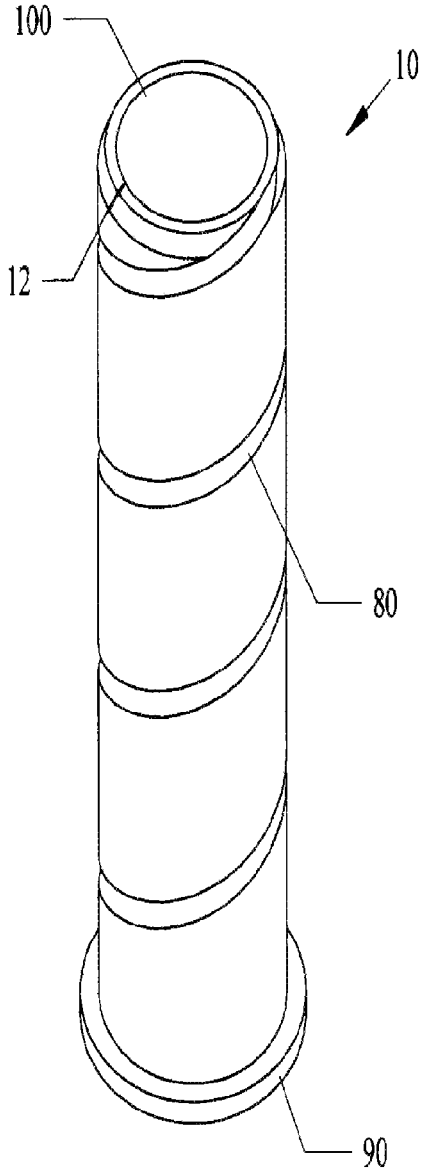
FIG. 18 is a left side top perspective view of the toilet paper insert with spiral cut grooves of FIG. 11.
Figure 19:
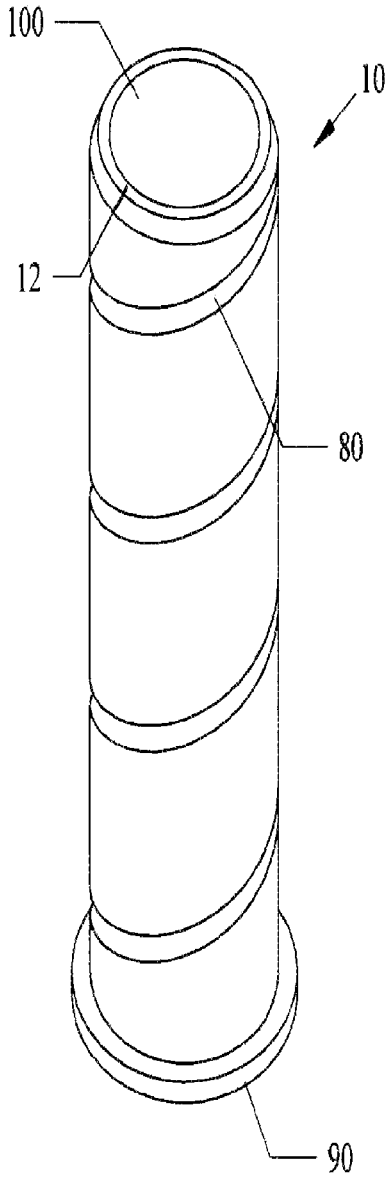
FIG. 19 is a back side top perspective view of the toilet paper insert with spiral cut grooves of FIG. 11.
Figure 20:
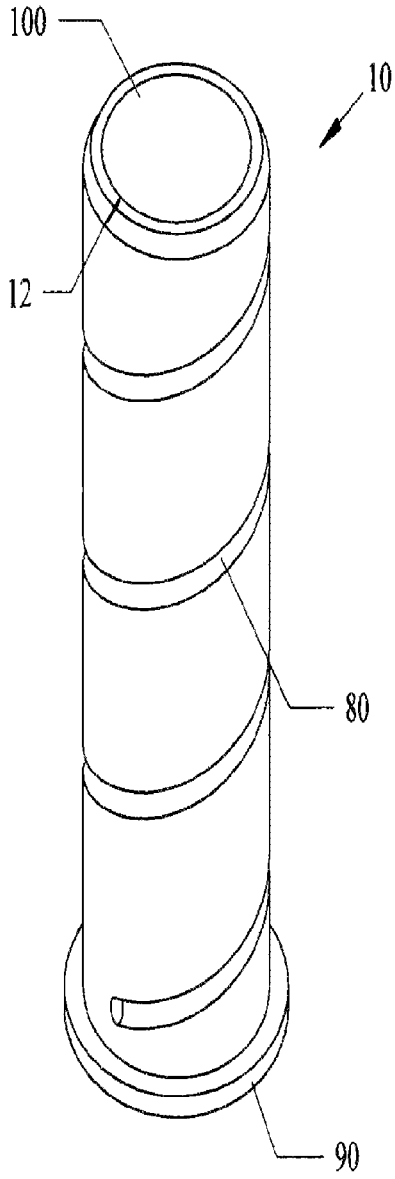
FIG. 20 is a right side top perspective view of the toilet paper insert with spiral cut grooves of FIG. 11.

FIG. 11 is a front side view of the toilet paper insert 10 with spiral grooves 80 cut into the outer wall of the insert 10 shown in FIGS. 1-5. FIG. 11A is a cross-sectional view of the insert 10 of FIG. 11 along arrows 11A. FIG. 12 is a left side view of the toilet paper insert 10 with spiral cut grooves 80 of FIG. 11. FIG. 13 is a back side view of the toilet paper insert 10 with spiral cut grooves 80 of FIG. 11. FIG. 14 is a right side view of the toilet paper insert 10 with spiral cut grooves 80 of FIG. 11. FIG. 15 is a top end view of the toilet paper insert 10 with spiral cut grooves 80 of FIG. 11. FIG. 16 is a bottom end view of the toilet paper insert 10 with spiral cut grooves 80 of FIG. 11. FIG. 17 is a front side top perspective view of the toilet paper insert 10 with spiral cut grooves 80 of FIG. 11. FIG. 18 is a left side top perspective view of the toilet paper insert 10 with spiral cut grooves 80 of FIG. 11. FIG. 19 is a back side top perspective view of the toilet paper insert 10 with spiral cut grooves 80 of FIG. 11. FIG. 20 is a right side top perspective view of the toilet paper insert 10 with spiral cut grooves 80 of FIG. 11.

Referring to FIGS. 11-20, the toilet paper insert 10 can be formed from injection molded plastic material, such as but not limited to ABS, Polycarbonate, Nylon, PC-ABS, Polypropylene, PVC, fiberglass, and the like, as well as from recycled plastic. Alternatively, the insert can be formed from other materials, such as but not limited to wood, metal, combinations, thereof, and the like.

Insert 10 can have a length of approximately 4 inches long. The outer diameter of the insert 10 can have a cylindrical diameter of approximately 1.250 inches, and the inner diameter of the central hole 100 can have a diameter of approximately 1.00 inches.

The spiral cut groove 80 can run from the base flange 90 to the tip end 12, and have a spiral pitch spacing between winds of approximately 1.00 inches. With these dimensions, the insert 10 can take approximately 4 turns to be fully inserted into the toilet paper roll. The spiral groove cut 80 can be approximately 0.063 inches deep and have a width of approximately 0.125 inches.

At the tip end 12, there can be chamfered perimeter edge having an angle of approximately 20 degrees with a height of approximately 0.09 inches. The base flange 90, can have a thickness of approximately 0.10 inches, and have an outer diameter of approximately 1.50 inches. The outer surface edges of the base flange 90 can be knurled, and the like, for an enhanced gripping surface.

Toilet Paper Insert with Raised Spiral Ribs

Figure 21:
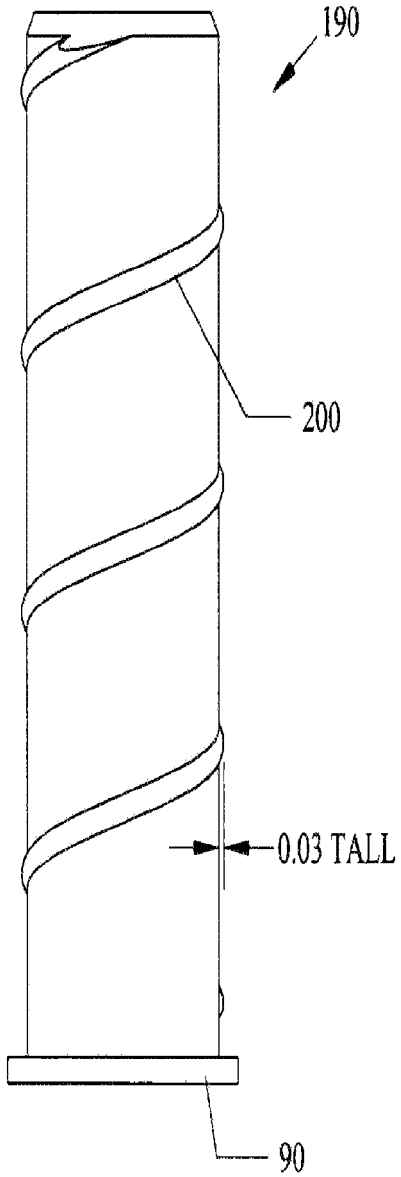
FIG. 21 is a front side view of a toilet paper roll tube insert with raised spiral ribs that can be used with the toilet paper roll dispenser of FIGS. 1-5.
Figure 22:
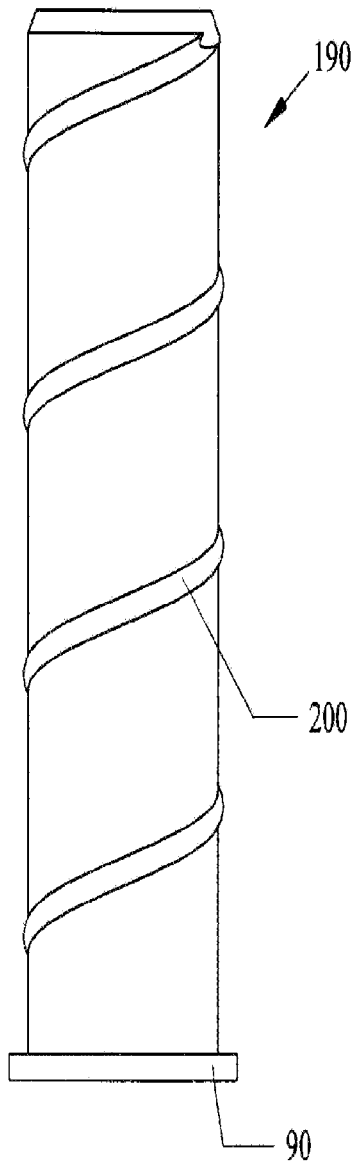
FIG. 22 is a left side view of the toilet paper roll with raised spirals of FIG. 21.
Figure 23:
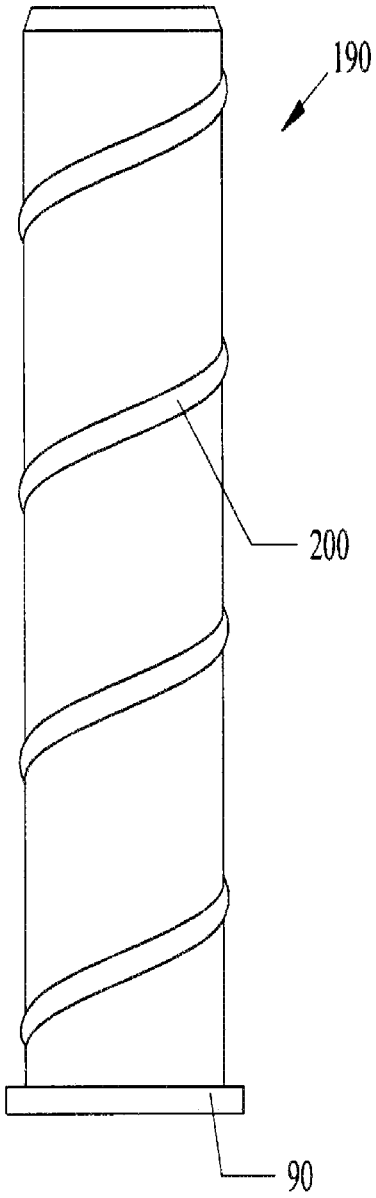
FIG. 23 is a back side view of the toilet paper roll with raised spirals of FIG. 21.
Figure 24:
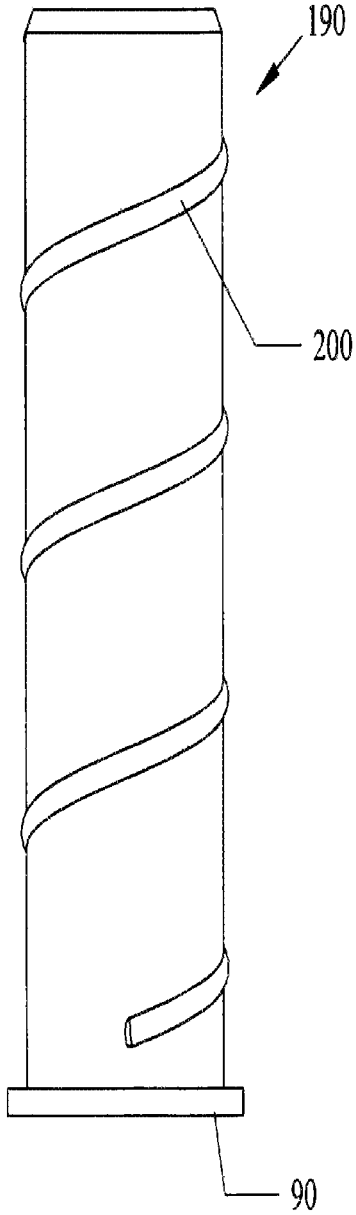
FIG. 24 is a right side view of the toilet paper roll with raised spirals of FIG. 21.
Figure 25:
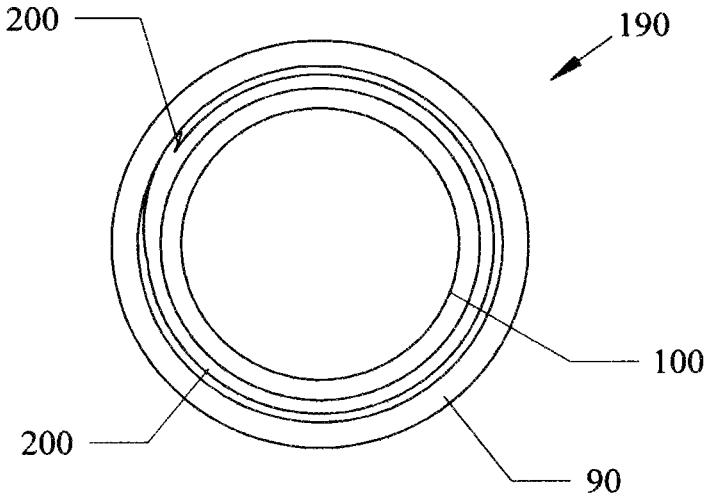
FIG. 25 is a top end view of the toilet paper roll with raised spirals of FIG. 21.
Figure 26:
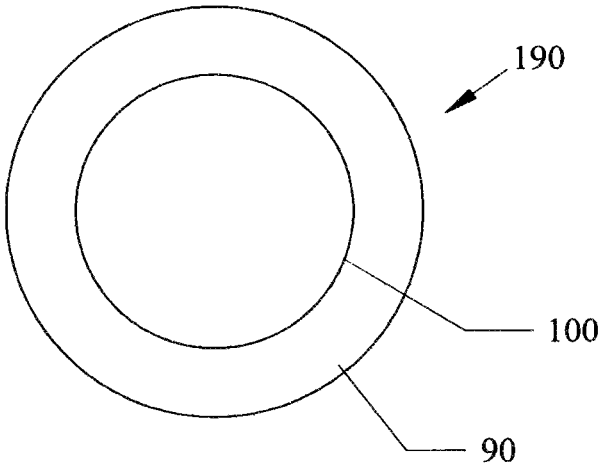
FIG. 26 is a bottom end view of the toilet paper roll with raised spirals of FIG. 21.
Figure 27:
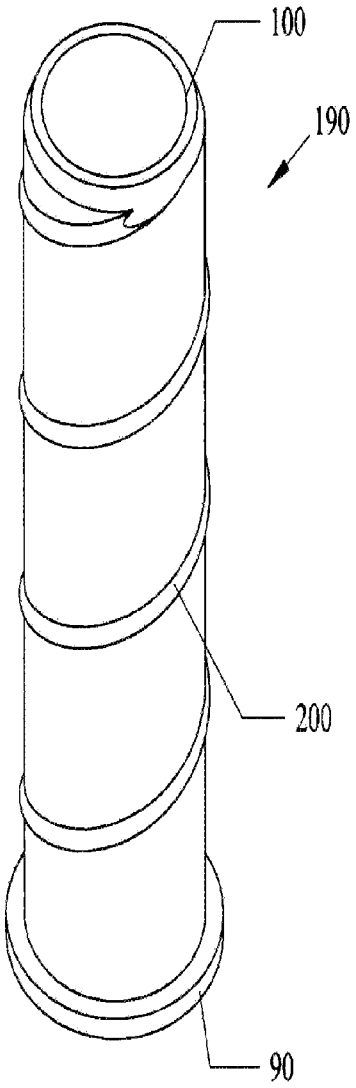
FIG. 27 is a front side top perspective view of the toilet paper roll with raised spirals of FIG. 21.
Figure 28:
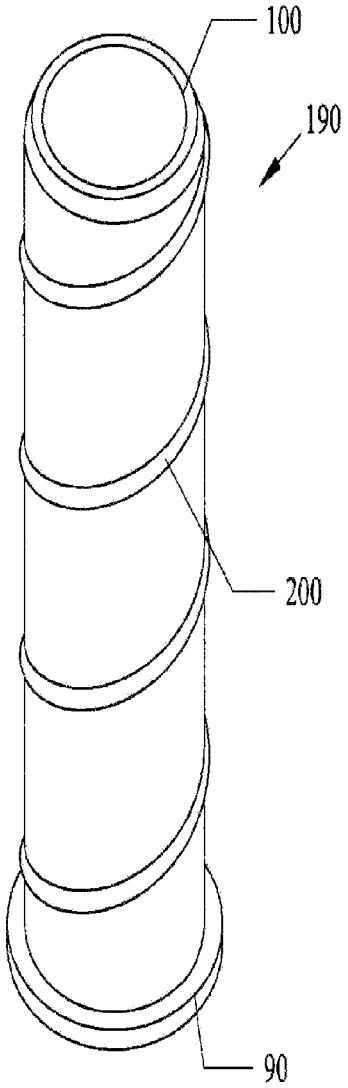
FIG. 28 is a left side top perspective view of the toilet paper roll with raised spirals of FIG. 21.
Figure 29:
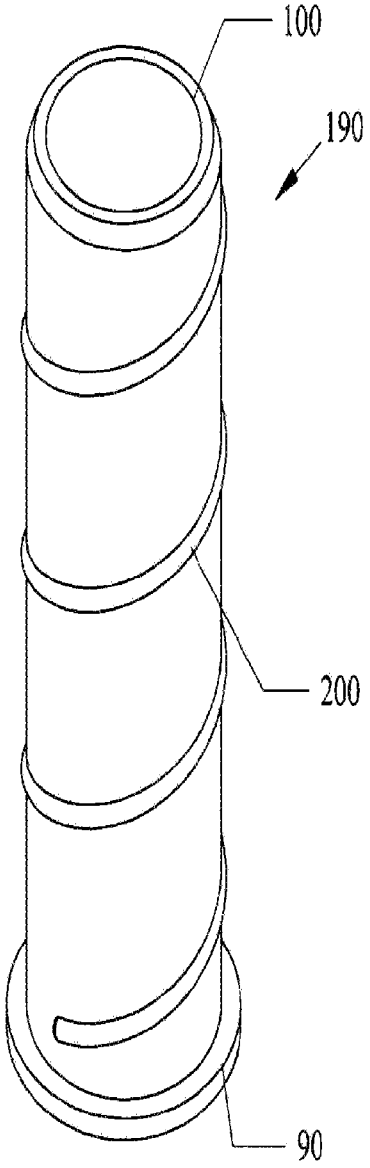
FIG. 29 is a back side top perspective view of the toilet paper roll with raised spirals of FIG. 21.
Figure 30:
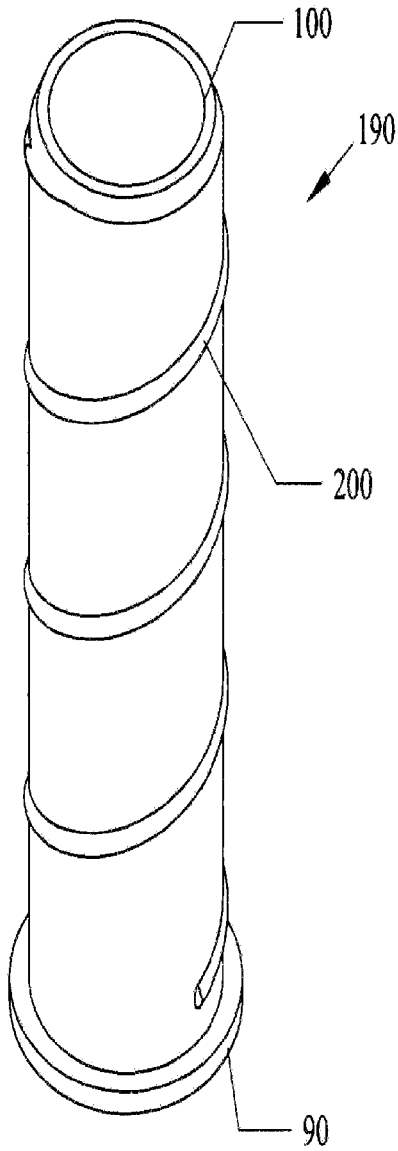
FIG. 30 is a right side top perspective view of the toilet paper roll with raised spirals of FIG. 21.

FIG. 21 is a front side view of a toilet paper roll tube insert 190 with raised spiral ribs 200 that can be used with the toilet paper roll dispenser 20 of FIGS. 1-5. FIG. 22 is a left side view of the toilet paper roll 190 with raised spirals 200 of FIG. 21. FIG. 23 is a back side view of the toilet paper roll 190 with raised spirals 200 of FIG. 21. FIG. 24 is a right side view of the toilet paper roll 190 with raised spirals 200 of FIG. 21. FIG. 25 is a top end view of the toilet paper roll 190 with raised spirals 200 of FIG. 21. FIG. 26 is a bottom end view of the toilet paper roll 190 with raised spirals 200 of FIG. 21. FIG. 27 is a front side top perspective view of the toilet paper roll 190 with raised spirals 200 of FIG. 21. FIG. 28 is a left side top perspective view of the toilet paper roll 190 with raised spirals 200 of FIG. 21. FIG. 29 is a back side top perspective view of the toilet paper roll 190 with raised spirals 200 of FIG. 21. FIG. 30 is a right side top perspective view of the toilet paper roll 190 with raised spirals 200 of FIG. 21.

Referring to FIGS. 21-30, the insert 190 can have similar dimensions and formed from similar material to the insert 10 of the previous embodiment, with the exception of having raised spiral raised ribs 200 molded thereon. The raised spiral ribs 200 can have a height of approximately 0.3 inches, and a thickness of approximately 0.125 inches.

Paper Towel Insert with Spiral Groove Cuts

Figure 6:
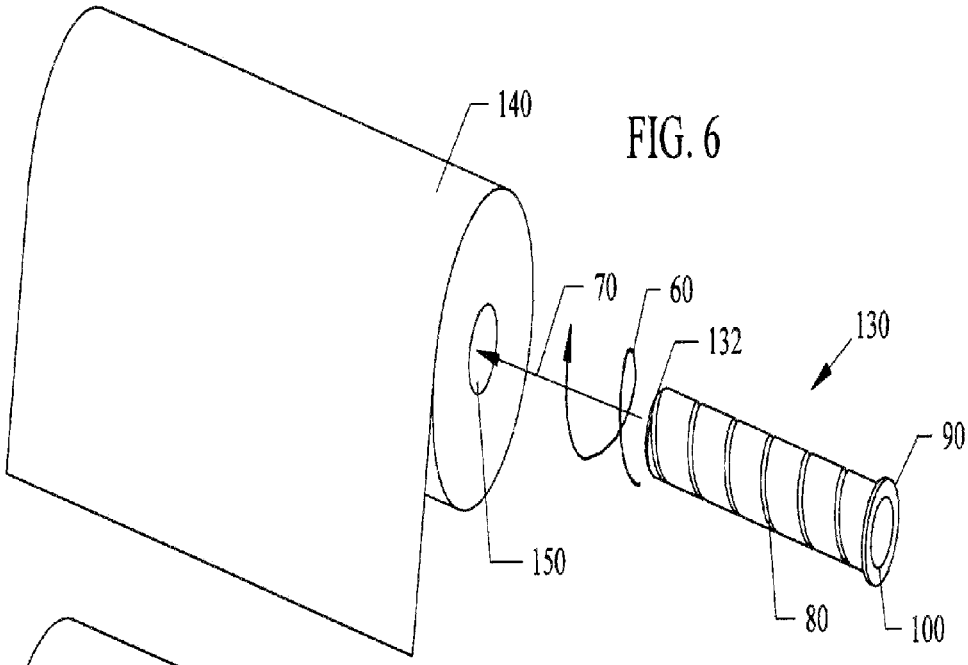
FIG. 6 is a perspective exploded view of a paper towel roll insert ready to be installed on a paper towel roll having no center cardboard core tube.
Figure 7:
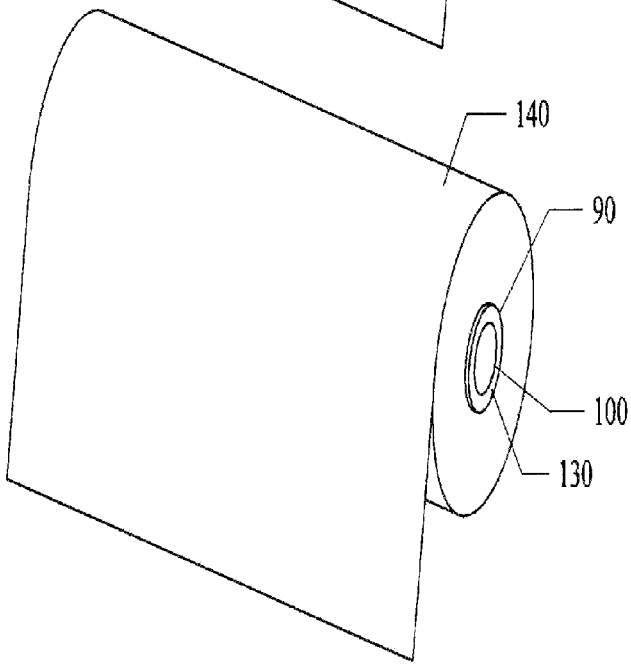
FIG. 7 is another perspective view of the insert fully installed within the paper towel roll of FIG. 6.
Figure 8:
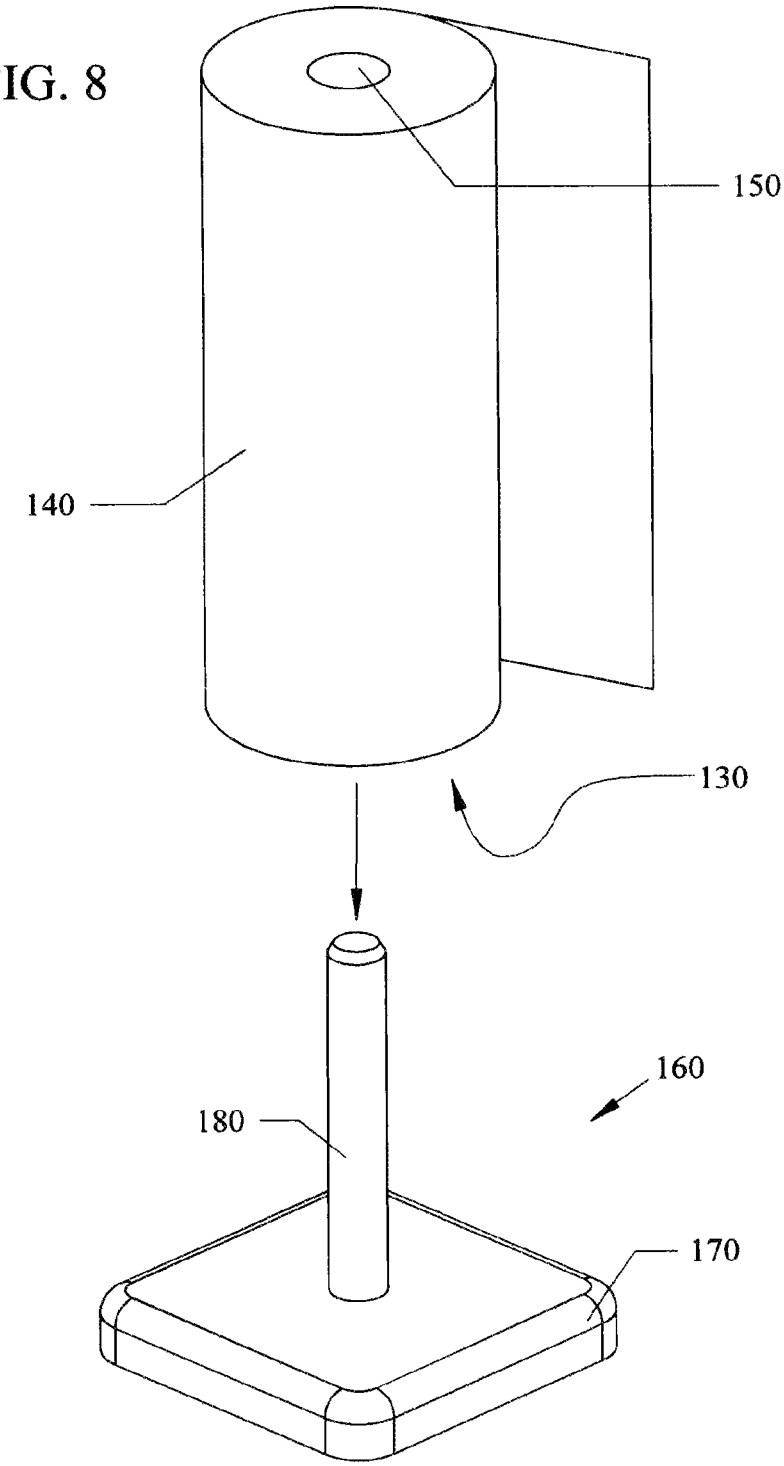
FIG. 8 is another perspective view of the paper towel with installed insert about to mounted to a dispenser.
Figure 9:
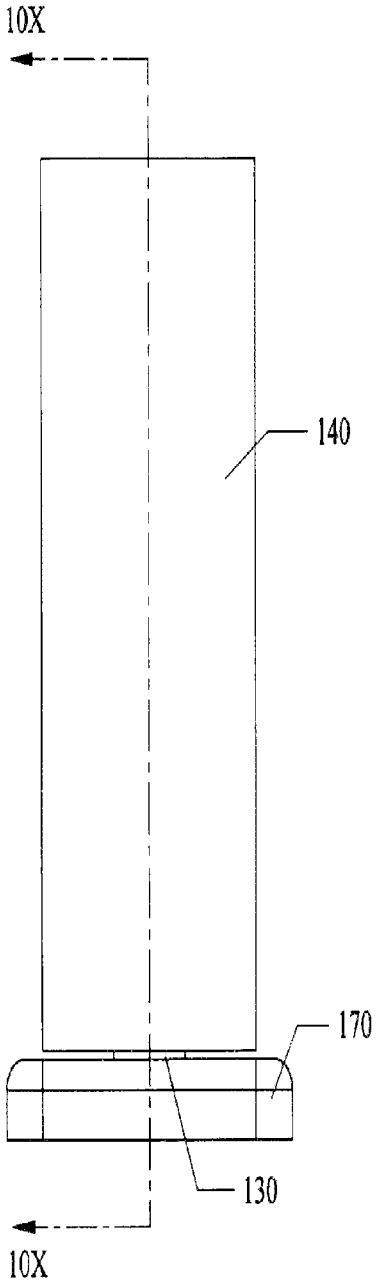
FIG. 9 is a side view of the paper towel with insert mounted on the dispenser of FIG. 8.
Figure 10:
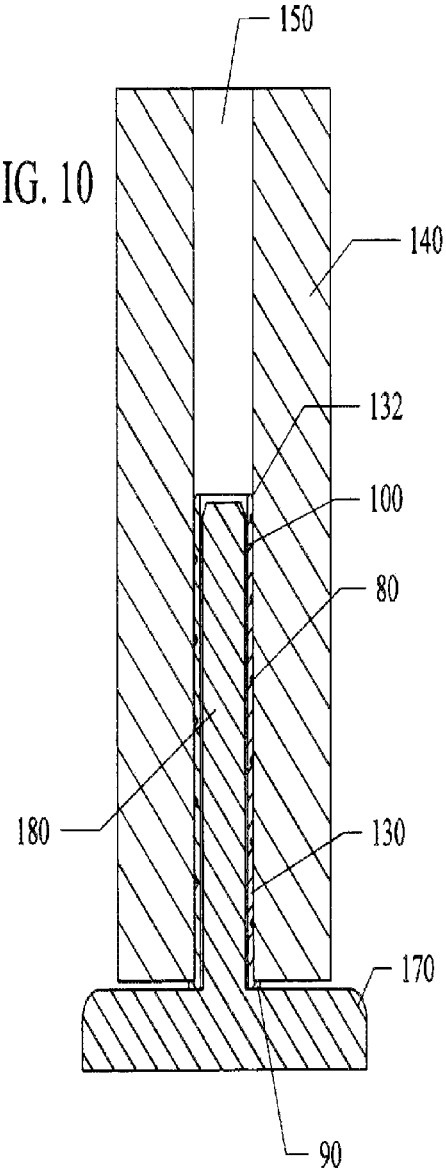
FIG. 10 is a cross-sectional view of the paper towel with insert mounted on the dispenser of FIG. 9 along arrow 10X.

FIG. 6 is a perspective exploded view of a paper towel roll insert 130 ready to be installed on a paper towel roll 140 having no center cardboard core tube. FIG. 7 is another perspective view of the insert 130 fully installed within the paper towel roll 140 of FIG. 6. FIG. 8 is another perspective view of the paper towel 140 with installed insert 130 about to mounted to a paper towel holder 160, such as a stand, or dispenser, and the like. FIG. 9 is a side view of the paper towel 140 with insert 130 mounted on the holder 160 of FIG. 8. FIG. 10 is a cross-sectional view of the paper towel 140 with insert 130 mounted on the holder 160 of FIG. 9 along arrow 10X.

Referring to FIGS. 6-10, the novel insert 130 can be a hollow plastic tube having a flange 90 on one end and a tip end 12 having a chamfered tip edges about the perimeter of the tip end 12. The insert can have a spiral groove 80 cut onto the outside surface of the plastic tube insert 130. The paper towel roll 140 can be one without an axial cardboard tube, where the central opening 150 can be small and not clearly defined. The installer can take the insert 130 by base flange 90 and position the tip end 132 at the front of the hole 150. The installer can push in the direction of arrow 70 and rotate the insert clockwise in the direction of arrow 60 so that that chamfered tip edges drive into the hole 150 until the insert 130 is fully inserted where the flange 90 abuts against one side of the roll 140. In the installed position, the central hole 150 of the roll can be generally made uniform in diameter and have inner walls that abut against the outer surface of the insert 130.

Next the paper towel 140 with installed insert 130 can be positioned so that the center hole 100 of the insert can be slid over the post 180 until the base flange 90 rests on the base 170 of the towel holder 160. While a stand type holder is shown, the paper towel insert 130 can also be mounted on posts/rods/telescoping cylinders similar to those shown and described in the previous embodiment. The insert will be more fully described in relation to FIGS. 31-40.

Figure 31:
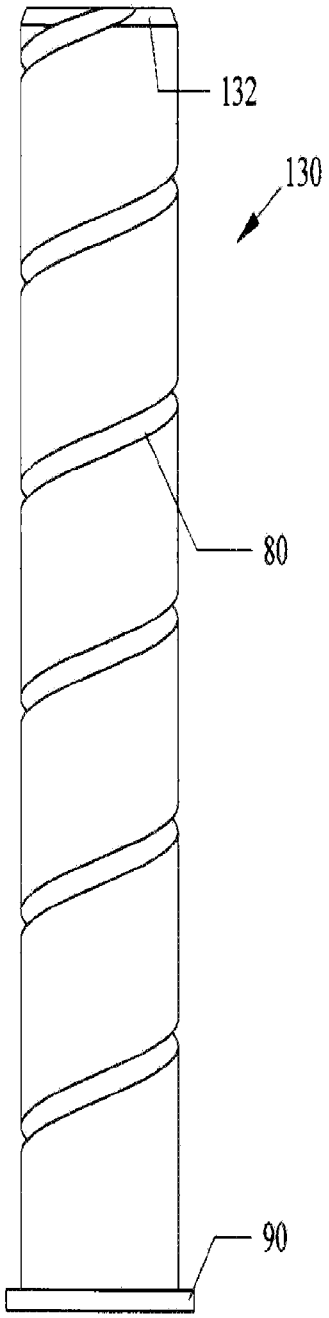
FIG. 31 is a front side view of a paper towel tube insert with spiral cut grooves used in FIGS. 6-10.
Figure 32:
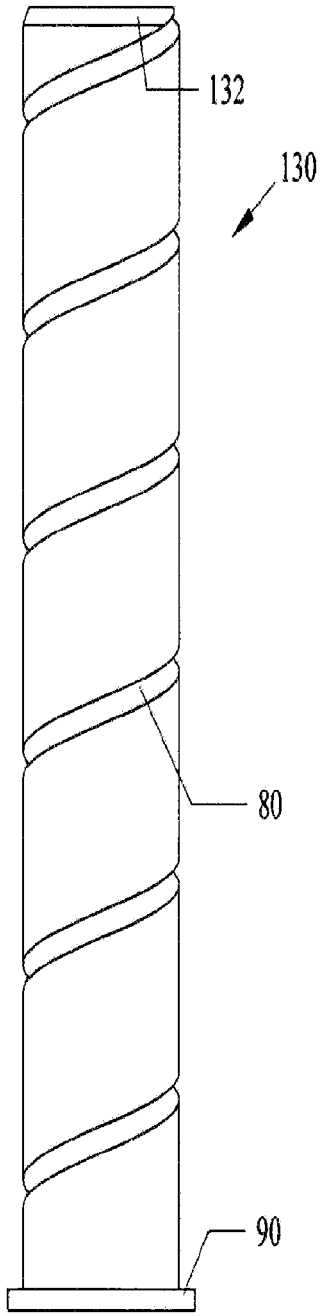
FIG. 32 is a right side view of the paper towel tube insert with spiral cut grooves of FIG. 31.
Figure 33:
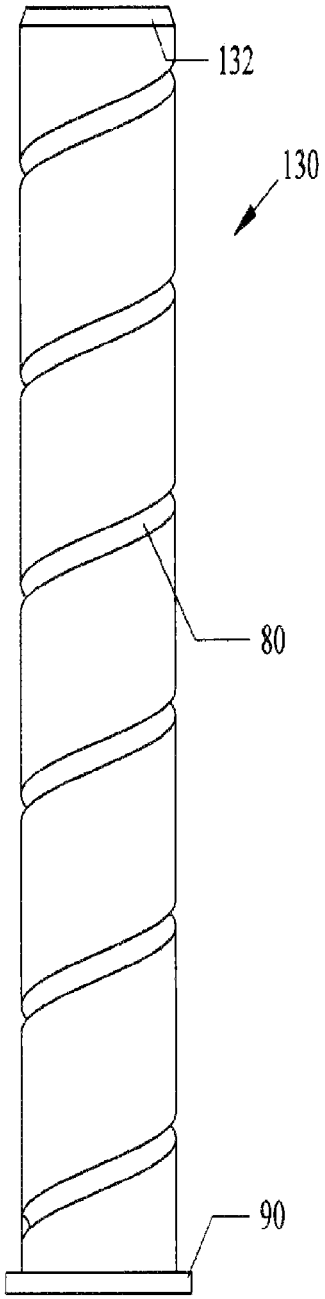
FIG. 33 is a back side view of the paper towel tube insert with spiral cut grooves of FIG. 31.
Figure 34:
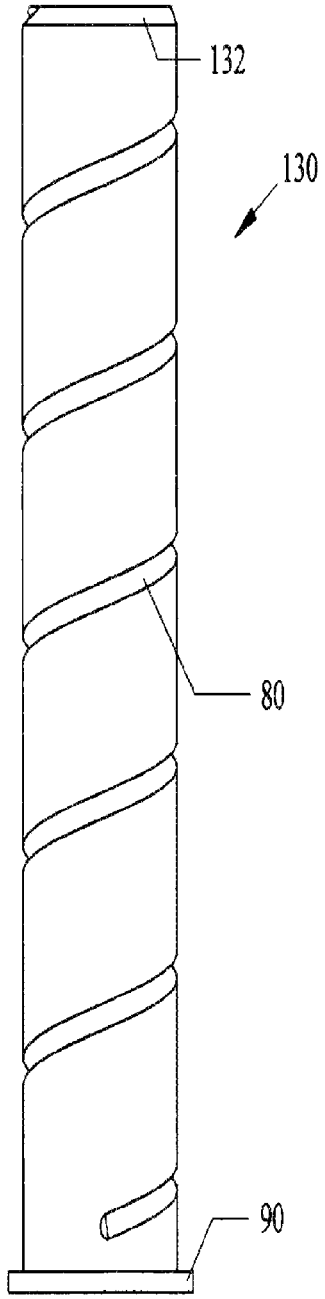
FIG. 34 is a left side view of the paper towel tube insert with spiral cut grooves of FIG. 31.
Figure 35:
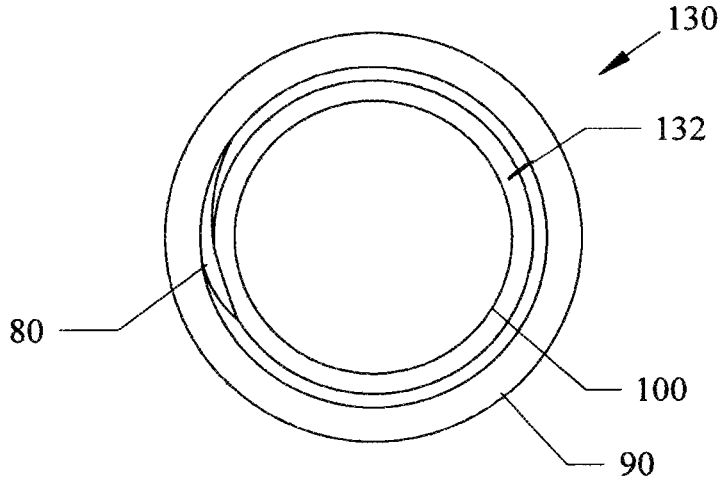
FIG. 35 is a top end view of the paper towel tube insert with spiral cut grooves of FIG. 31.
Figure 36:
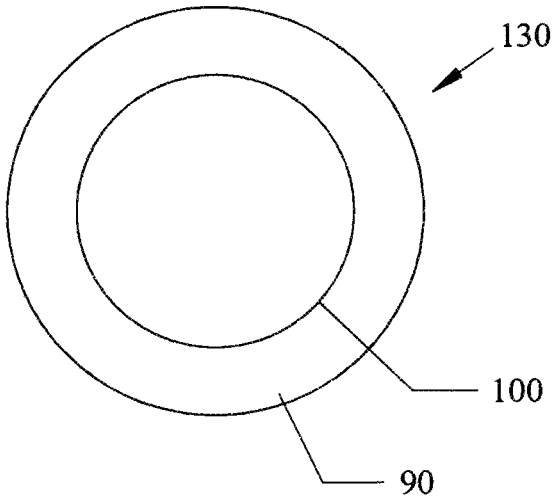
FIG. 36 is a bottom end view of the paper towel tube insert with spiral cut grooves of FIG. 31.
Figure 37:
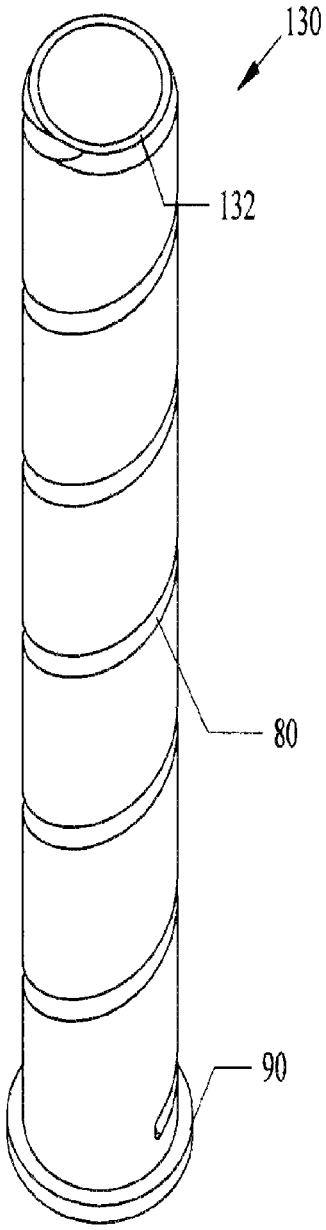
FIG. 37 is a front side top perspective view of the paper towel tube insert with spiral cut grooves of FIG. 31.
Figure 38:
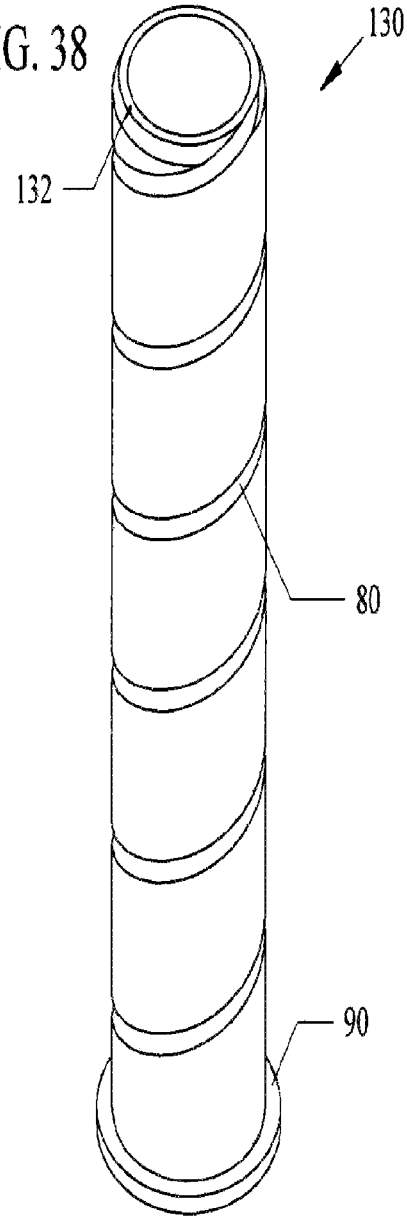
FIG. 38 is a left side top perspective view of the paper towel tube insert with spiral cut grooves of FIG. 31.
Figure 39:
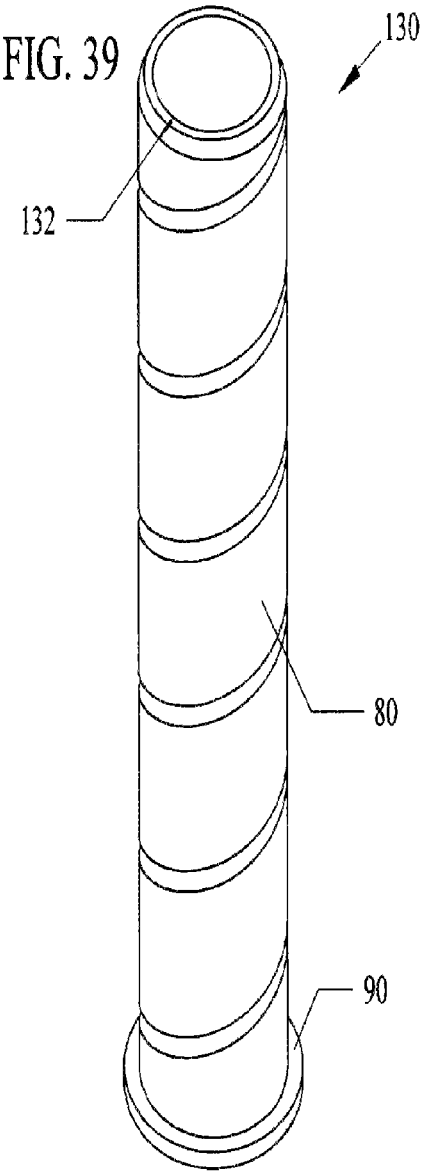
FIG. 39 is back side top perspective view of the paper towel tube insert with spiral cut grooves of FIG. 31.
Figure 40:
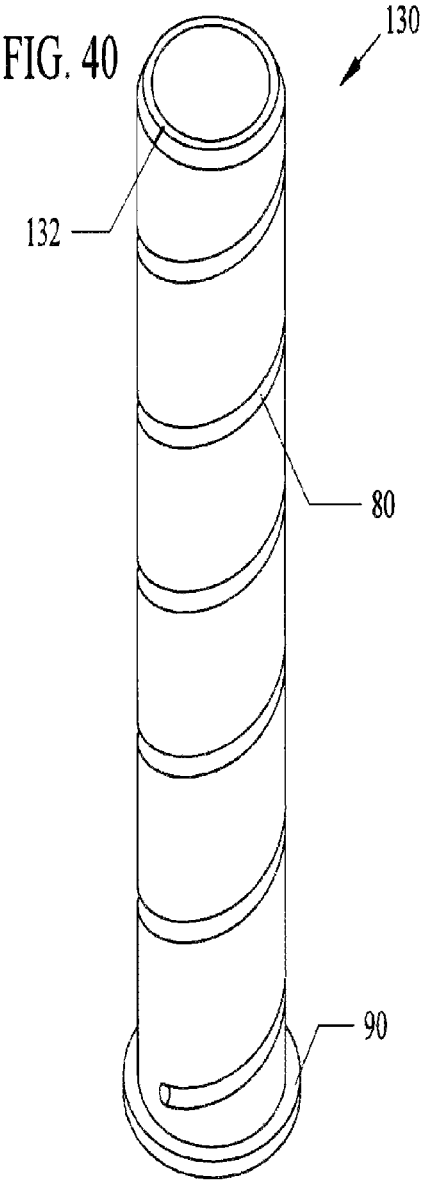
FIG. 40 is a right side top perspective view of the paper towel tube insert with spiral cut grooves of FIG. 31.

FIG. 31 is a front side view of a paper towel tube insert 130 with spiral cut grooves 80 used in FIGS. 6-10. FIG. 32 is a right side view of the paper towel tube insert 130 with spiral cut grooves 80 of FIG. 31. FIG. 33 is a back side view of the paper towel tube insert 130 with spiral cut grooves 80 of FIG. 31. FIG. 34 is a left side view of the paper towel tube insert 130 with spiral cut grooves 80 of FIG. 31. FIG. 35 is a top end view of the paper towel tube insert 130 with spiral cut grooves 80 of FIG. 31. FIG. 36 is a bottom end view of the paper towel tube insert 130 with spiral cut grooves 80 of FIG. 31. FIG. 37 is a front side top perspective view of the paper towel tube insert 130 with spiral cut grooves 80 of FIG. 31. FIG. 38 is a left side top perspective view of the paper towel tube insert 130 with spiral cut grooves 80 of FIG. 31. FIG. 39 is back side top perspective view of the paper towel tube insert 130 with spiral cut grooves 80 of FIG. 31. FIG. 40 is a right side top perspective view of the paper towel tube insert 130 with spiral cut grooves 80 of FIG. 31.

Referring to FIGS. 31-40, the paper towel insert 130 can be formed from similar materials as the previously described embodiments, and have similar dimensions for the chamfered tip edges 132, and width and depth of the spiral grooves 80, but with the following differences.

Here, the length of the paper towel insert 130 can be approximately 6 inches for ease in installation. In the figures, a 6 inch long insert can have approximately 6 winds each being approximately 1 inch apart from one another, so that the insert 130 can be inserted into the opening 150 of the paper towel roll 140 within approximately 6 turns. The insert 130 can also have a length of up to approximately 11 inches or substantially the same length as that of a paper towel roll 140. The outer diameter of the insert 130 can be approximately 1.50 inches and the inner diameter can be approximately 1.25 inches. The outer diameter of the flange base can be approximately 1.75 inches and have a thickness of approximately 0.13 inches.

Paper Towel Insert with Raised Spiral Ribs

The paper towel insert can also have spiral ribs similar to those shown and described for the toilet paper roll. The paper towel insert with raised spiral ribs can have similar dimensions to the paper towel insert with spiral grooves. The spiral ribs can be located in the same locations, where each of the ribs can have a height of approximately 0.03 inches and a thickness of approximately 0.11 inches thick.

Although the embodiments describe inserting the inserts into the holes of the paper rolls, the inserts can be removed by rotating counter-clockwise while pulling out at the base flanges of the inserts.

The dimensions shown in all the figures can be preferred values. The term approximately used in the description for various dimensions, can allow for plus or minus 10 (ten) percent of the listed number.

Although the drawings and description show the spiral grooves/ribs oriented so that the inserts can be rotated clockwise, the grooves/ribs can be oriented so that the inserts can be rotated into their respective paper rolls in clockwise directions.

Although paper towels and toilet paper rolls are described, the invention can be used for other rolls such as but not limited to rolls of silk, wool, and other types of rollable sheet material, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An adapter tool for paper rolls that do not have inner cardboard tubes, comprising:

a hollow cylinder having a first end and a second end opposite the first end with a generally uniform diameter opening therebetween, wherein the first end has a chamfered edge uniformally about the first end, and the second end has an enlarged base having an outer diameter greater than the outer diameter of the hollow cylinder; and a spiral on the exterior surface of the hollow cylinder between the first end and the second end, and the spiral runs into the chamfered edge on the first end, wherein the first end is adapted to be pushed into a central opening of a paper roll that does not have an inner cardboard tube, and the hollow cylinder is able to be rotated by the second end until substantially all of the hollow insert is located inside the central opening of the paper roll.

2. The adapter tool of claim 1, wherein the hollow cylinder has a length of at least approximately 4 inches between the first end and the second end, and the paper roll is a toilet paper roll without an inner cardboard tube.

3. The adapter tool of claim 1, wherein the chamfered edge has an angle of approximately 30 degrees.

4. The adapter tool of claim 1, wherein the spiral includes a spiral cut groove having a cut approximately 0.063 inches deep.

5. The adapter tool of claim 4, wherein the spiral cut groove includes: a width of approximately 0.125 inches.

6. The adapter tool of claim 1, wherein the spiral includes: an approximately 1 inch spiral pitch.

7. The adapter tool of claim 1 wherein the spiral includes a spiral raised rib having a height of approximately 0.3 inches.

8. The adapter tool of claim 1, wherein the spiral includes a spiral raised rib having a thickness of approximately 0.125 inches.

9. The adapter tool of claim 1, wherein the hollow cylinder has a length of at least approximately 6 inches between the first end and the second end, and the paper roll is a paper towel roll without an inner cardboard tube, and the spiral has a spiral cut groove approximately 0.063 inches deep.

10. The adapter tool of claim 1, wherein the hollow cylinder has a length of at least approximately 6 inches between the first end and the second end, and the paper roll is a paper towel roll without an inner cardboard tube, and the spiral has a spiral cut groove includes: a width of approximately 0.125 inches.

11. The adapter tool of claim 1, wherein the hollow cylinder has a length of at least approximately 6 inches between the first end and the second end, and the paper roll is a paper towel roll without an inner cardboard tube, and the spiral has a spiral cut groove having an approximately 1 inch spiral pitch.

12. The adapter tool of claim 1, wherein the spiral includes a spiral raised rib having a height of approximately 0.3 inches.

13. The adapter tool of claim 12, wherein the spiral raised rib includes: a thickness of approximately 0.125 inches.

14. A method of mounting paper towel rolls that do not have inner cardboard tubes, on paper dispensers, comprising the steps of:

providing a paper roll with a central opening that does not have an inner cardboard tube, the roll being selected from a toilet paper roll and a paper towel roll;

providing a cylinder having a tip end with a chamfered edge uniformally about the tip end, and an opposite end with an enlarged base;

providing a spiral on an exterior surface of the cylinder between the tip end and the base, so that the spiral runs into the chamfered edge on the tip end;

pushing and rotating the tip end of the base into the central opening of the paper roll with the enlarged base until the cylinder is substantially inside the central opening of the paper roll, and the enlarged base abuts against a side surface of the paper roll.

15. The method of claim 14, further comprising the steps of:

providing the spiral as a spiral groove or spiral raised rib; and providing the spiral with an approximately 1.00 inch spiral pitch.

16. An adapter tool for paper rolls that do not have inner cardboard tubes, comprising:

an elongated insert having a first end and a second end opposite the first end with a generally uniform diameter therebetween, wherein the first end has a chamfered edge uniformally about the first end, and the second end has an enlarged base having an outer diameter greater than the outer diameter of the elongated insert; and a spiral on the exterior surface of the elongated insert between the first end and the second end so that the spiral runs into the chamfered edge on the first end, wherein the first end is adapted to be pushed into a central opening of a paper roll that does not have an inner cardboard tube, and the elongated insert is able to be rotated by the second end until substantially all of the elongated insert is located inside the central opening of the paper roll.

17. The adapter tool of claim 1, wherein the chamfered edge has an angle of approximately 20 degrees.

18. The adapter tool of claim 1, wherein the chamfered edge has height of approximately 0.09 inches, and the first end has a substantially flat exterior surface.

19. The method of claim 14, further comprising the steps of:

providing the chamfered edge with a height of approximately 0.09 inches; and providing the tip end with a substantially flat exterior surface.

20. The adapter tool of claim 16, wherein the chamfered edge has a height of approximately 0.09 inches and an angle selected from one of approximately 20 degrees and approximately 30 degrees.

* * * * *